US006681601B2

(12) United States Patent
Li

(10) Patent No.: US 6,681,601 B2
(45) Date of Patent: Jan. 27, 2004

(54) METHOD FOR MANUFACTURING A BRIM-INTEGRATED TYPE CAP

(76) Inventor: Song-Taek Li, San 65-41, Sangdo 4-Dong, Seoul, Donjak-ku (KR)

( * ) Notice: Subject to any disclaimer, the term of this patent is extended or adjusted under 35 U.S.C. 154(b) by 0 days.

(21) Appl. No.: 10/223,453

(22) Filed: Aug. 19, 2002

(65) Prior Publication Data

US 2003/0056551 A1 Mar. 27, 2003

(30) Foreign Application Priority Data

Aug. 22, 2001 (KR) ..... 2001-0050800
Sep. 5, 2001 (KR) ..... 2001-0054316
Jul. 12, 2002 (KR) ..... PCT/KR02/01316

(51) Int. Cl.[7] ..... A42B 1/04; D04B 1/24
(52) U.S. Cl. ..... 66/171; 2/195.8
(58) Field of Search ..... 66/169 R, 170, 66/171, 173, 189, 64; 2/175.1, 195.7, 195.8, 195.1

(56) References Cited

U.S. PATENT DOCUMENTS 442,921 A * 12/1890 Stohr ..... 2/172
1,672,611 A * 6/1928 Gold ..... 2/172
1,796,689 A * 3/1931 Grumbach ..... 66/171
1,804,356 A * 5/1931 Lowenthal ..... 2/172
1,843,100 A * 1/1932 Stout ..... 66/189
1,906,212 A * 4/1933 Lacks et al. ..... 66/171
1,915,092 A * 6/1933 Hendrickson ..... 66/171
2,133,619 A * 10/1938 Hutton ..... 2/172
2,149,655 A * 3/1939 Yamaguchi ..... 66/171
2,264,594 A * 12/1941 Schuessler ..... 2/172
2,566,635 A * 9/1951 Reddy ..... 2/175.5
2,664,725 A * 1/1954 Schuessler ..... 66/171
2,707,381 A * 5/1955 Lombardi ..... 66/171
4,141,229 A * 2/1979 Sharpe ..... 66/171
4,571,959 A * 2/1986 Chesebro et al. ..... 66/169 R
6,003,345 A * 12/1999 Jordan ..... 66/215
6,318,131 B1 * 11/2001 Kobata et al. ..... 66/64

* cited by examiner

*Primary Examiner*—Danny Worrell
(74) *Attorney, Agent, or Firm*—Lahive & Cockfield, LLP

(57) ABSTRACT

A method for manufacturing a peak-integrated type cap that can reduce the number of sewing processes required is provided. The method includes the steps of: forming one side of a head fitting part in an one-to-one knitting pattern, while forming a peak on the center thereof in a plain knitting pattern, the peak formed by using a select knitting manner where it is decreased in width and increased at the time of reaching a predetermined width and also knitted by connecting the both peripheries thereof such that it is generally in the shape of a pocket; forming a folding part such that the other side of the head fitting part knitted in abutment with the one side thereof is easily folded; and forming the root part of the peak, while the other side of the head fitting part is being formed.

12 Claims, 9 Drawing Sheets

METHOD FOR MANUFACTURING A BRIM-INTEGRATED TYPE CAP

RELATED APPLICATION

This application claims priority to, and the benefit of, co-pending Korean Patent Application No. 2001-0050800, filed on Aug. 22, 2001, Korean Patent Application Provisional Application No. 2001-0054316, filed on Sep. 5, 2001, and PCT Application No. PCT/KR02/01316 filed on Jul. 12, 2002 for all subject matter common to all applications.

FIELD OF THE INVENTION

The present invention relates to a method for manufacturing a brim-integrated type cap that is capable of making a piece of raw cloth for the cap on which a crown, a brim and a head fitting part are formed integrally with each other. A series of sewing processes otherwise needed for connecting the crown of the cap and the brim thereof and for connecting a sweat absorbing part on the inside of the crown can be advantageously avoided. This enables the production cost of the cap to be reduced.

BACKGROUND OF THE INVENTION

Generally, headgear is worn on the head of a human to protect his or her hair from strong light or heat, or for the purpose of decoration. Headgear has been developed in various kinds and shapes, and also made of a variety of materials, such as, for example, paper, silk, synthetic resin, etc.

In case of a cap with a brim at the front, the cap includes a crown that forms a body of the cap, the brim that is sewn to the crown for veiling sunlight, and a sweat absorbing part sewn within the inside of the crown, such that it comes in contact with the periphery of the head (including the forehead) when a user wears the cap, thereby functioning to absorb the sweat coming through his or her skin.

In manufacturing such a cap, typically, the crown is cut into four or six parts and the top ends of the four or six parts gather, such that the crown takes a generally round shape like the head, without any laying of the cut parts on each other. The respective cut parts are then sewn together. The brim formed at the front of the cap is manufactured in such a manner that a brim pad is inserted into a piece of cloth that is of a generally semicircular or crescent shape. The front part of the crown and the brim of the cap are then sewn. The band type sweat absorbing part that absorbs the sweat coming through the forehead is disposed and then sewn on the inside surface of an edge of the lower portion of the crown, i.e., the portion with which the periphery of the head comes in contact, thereby completing a desired cap.

As mentioned above, the processes of sewing at least the crown itself and the brim itself, as well as sewing the brim with the crown, are necessary. This causes the production cost of a cap to be relatively high, and also renders the number of caps manufactured per hour undesirably decreased.

SUMMARY OF THE INVENTION

To solve the above-described problems, the present invention provides a method for manufacturing a brim-integrated type cap in which a cap is made of a piece of raw cloth such that a crown, a brim and a head fitting part of the cap are formed integrally with each other.

To accomplish this and other objects of the present invention, there is provided a method for manufacturing a brim-integrated type cap, which includes the steps of: forming one side of a head fitting part in a one-to-one knitting pattern, while forming a brim on the center thereof in a plain knitting pattern, the brim formed by using a select knitting manner where it is decreased in width and increased at the time of reaching a predetermined width and also knitted by connecting both peripheries thereof such that it is in the shape of a general pocket; forming a folding part in a front or back knitting manner such that the other side of the head fitting part knitted in abutment with the one side thereof is easily folded; and forming the root part of the brim, while the other side of the head fitting part is being formed in a one-to-one knitting pattern.

Preferably, the crown of the cap is knitted after the completion of the head fitting part, or knitted before the formation of the brim of the cap.

Preferably, the method further includes the steps of inserting a fixing yarn into the brim of the cap at the time of knitting, and placing the cap with the knitted brim thereon into a mold, whereby the cap is fixed and is kept in the original shape of the brim without the insertion of a brim pad.

Since the head fitting part comes in direct contact with the periphery of the head, preferably, the head fitting part is knitted along with a cotton or natural yarn such that the head fitting part effectively absorbs the sweat coming to the face of a user.

The brim or the head fitting part is knitted along with a rubber yarn having flexibility such that the cap is applied in a variety of sizes.

The cap according to the present invention is manufactured with a piece of raw cloth for the cap where the brim and the crown are formed integrally with each other, such that the production cost thereof can be considerably reduced.

BRIEF DESCRIPTION OF THE DRAWINGS

Further objects and advantages of the invention can be more fully understood from the following detailed description taken in conjunction with the accompanying drawings, in which.

DETAILED DESCRIPTION

Figure 1:
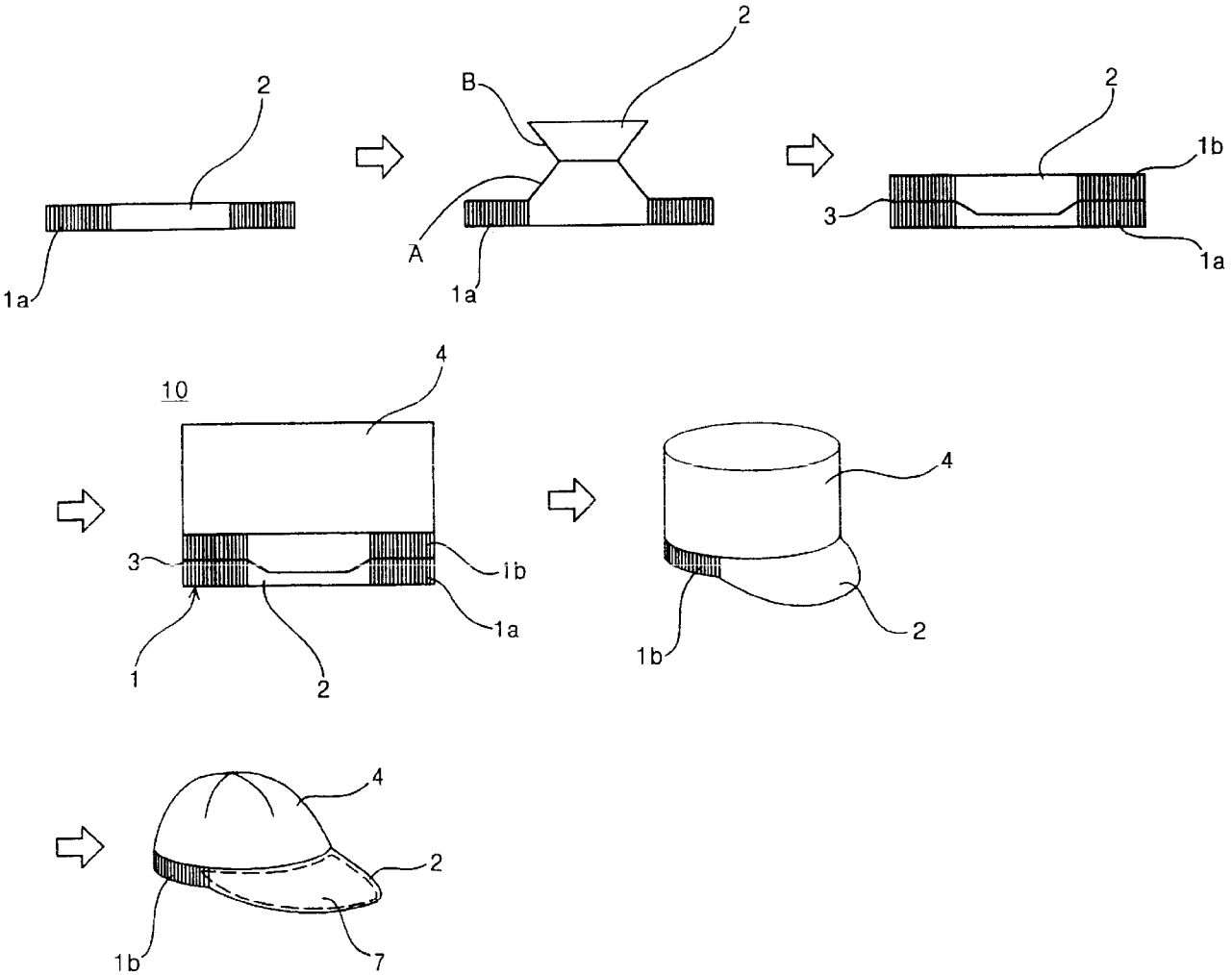
FIG. 1 is a flow diagram illustrating a method for manufacturing a brim-integrated type cap according to a first embodiment of the present invention.

An explanation of the preferred embodiments of the present invention will be described with reference to accompanying drawings. To understand the embodiments of the present invention, an explanation of a knitting machine used for embodying the principles of the present invention will be first described.

To manufacture the brim-integrated type cap according to the present invention, a computer is provided for implementing a knitting program, and a knitting machine is provided for operating the knitting program in response to an execution command from the computer.

The knitting machine is provided with a front needle bed and a back needle bed, each of the beds having needles that are thickly placed thereon. A yarn carrier rail is formed on the upper sides of the needle beds, on which a yarn carrier connected to a yarn is disposed. A carriage moves left and right along the yarn carrier rail and the formation path of the needle beds. A control box receives the signals transmitted from the computer and controls the execution of the corresponding operation. The yarn carrier rail is configured in such a fashion that four rails are arranged in parallel relation with each other, each rail having two yarn carriers installed thereon. The carriage is provided with a cam that serves to adjust the size of a loop, a needle selector that selects a necessary needle, and a yarn carrier magnet that serves to hold the yarn carrier, such that the yarn carrier can carry the yarn, in the interior thereof. In this instance, the number of cams is 3 and the number of yarn carrier magnets is 8 in each cam, such that the carriage moves left and right for knitting, while the yarn carrier magnet moves in the state of holding one or two or more yarn carriers.

Alternatively, an operator executes knitting programming by using a computer in which the knitting program for producing a piece of raw cloth of the cap to be manufactured by the knitting machine is previously stored. To do this, the operator draws the whole shape of the piece of raw cloth for the cap on the computer in a mosaic manner and at the same time selects a knitting pattern, a size of a loop, a needle to be used and color of a yarn.

More specifically, if the operator executes the knitting program on the computer, an initial screen is displayed with generally square cells that are arranged in the form of a lattice. Command icons selecting the knitting pattern, the size of the loop, the needle to be used and the color of the yarn are arranged on the left side thereof. Using the desired command icons, the operator designates the knitting command on the corresponding cells, such as the formation of the mosaic pattern, thereby completing the whole shape of the piece of raw cloth for the cap. As the corresponding number for each of the needles disposed on the front and back needle beds is designated, the needle corresponding to the designated number is the needle to be used. In the same manner as above, as the corresponding number for each of the yarn carriers on the yarn carrier rails is designated, the color corresponding to the designated number is the color of the yarn to be used.

When the above-mentioned operation is complete, the whole shape of the piece of raw cloth for the cap to be manufactured is formed on the screen, in the state where each cell has a designated command. The operator stores the knitting program. If the operator starts to execute knitting for the cap, the computer transmits the data on the piece of raw cloth for the cap to the control box of the knitting machine. Under the control of the control box, the carriage, which is adapted to move along the formation paths of the needle beds and the yarn carrier rails, starts to move such that the yarn carrier magnets hold the yarn carriers on the yarn carrier rails, thereby carrying the yarns connected to the yarn carriers. On the other hand, the needle selector selects the needle necessary among the needles on the needle beds in accordance with the data signal transmitted from the computer, and the cam decides the size of the loop to be knitted in accordance with the signal transmitted from the computer. As a consequence, the desired knitting is executed according to the predetermined knitting pattern based upon the signals transmitted from the computer. This operation is repeatedly executed until the piece of raw cloth for the cap is produced.

Figure 2:
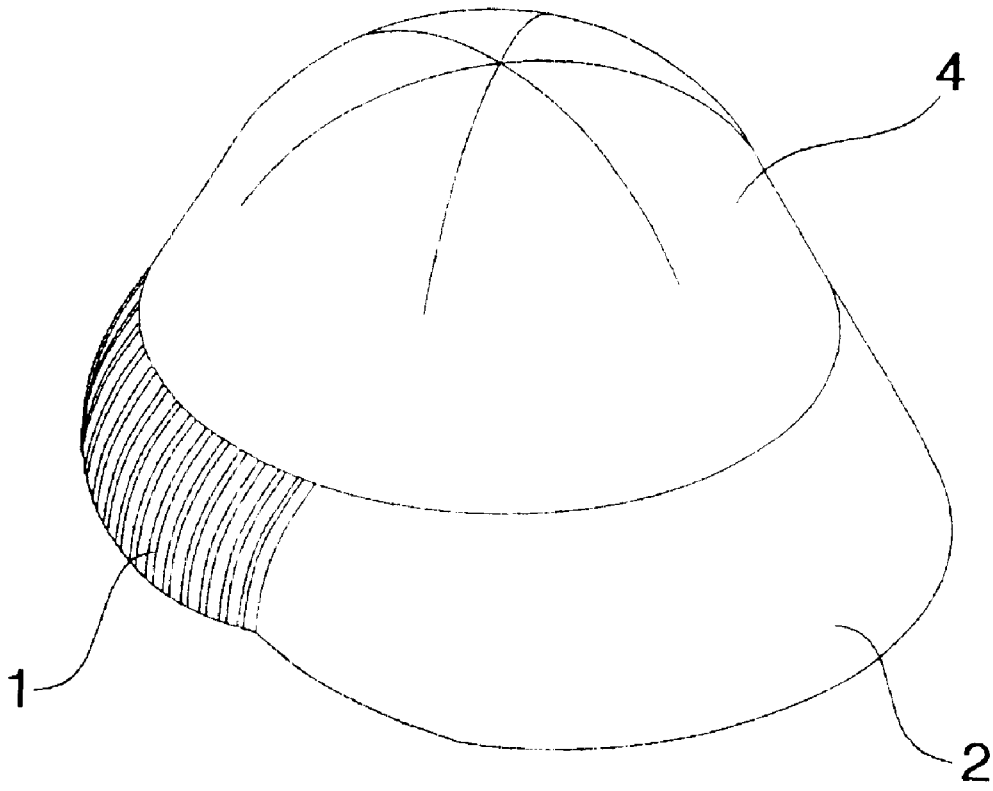
FIG. 2 is a perspective view illustrating the cap manufactured according to the first embodiment of the present invention.

FIG. 1 is a sequential diagram illustrating a method for manufacturing a brim-integrated type cap according to a first embodiment of the present invention. FIG. 2 is a perspective view illustrating the cap manufactured according to the teachings of the first embodiment of the present invention.

To knit a piece of cloth having the size corresponding to a piece of raw cloth 10 for the cap according to the first embodiment of the present invention. The following process can be executed. First, the needles that are formed on the front and back needle beds are appropriately selected, and an inside part 1*a* of a head fitting part 1 and a part of a brim 2 on the center of the cap are knitted. At this time, the head fitting part 1 is formed in an one-to-one knitting manner where the needles formed on the front and back needle beds are used in a zigzag way, and the brim 2 is formed in a plain knitting manner.

When knitting of the inside part 1*a* of the head fitting part 1 and the root part of the bottom portion of the brim 2 is completed, knitting of the other part of the brim 2 can begin. In this case, the brim 2 is formed in a select knitting manner, where the brim 2 gradually decreases the number of needles used as it moves from the root part to the protruding end such that the knitting width is reduced until the number of needles used in the knitting machine is reduced to a predetermined number of needles. The number of needles used gradually increases, such that the knitting width is increased to a predetermined number of needles.

At that time, in the processes of decreasing the knitting width and increasing the knitting width, the parts "A" and "B" as shown in FIG. 1 are connected in such a manner as to be protruded upward, thereby forming the whole shape of the brim 2, similar to a pocket.

Before the outside part 1*b* of the head fitting part 1 is knitted for connection with the inside part 1*a* of the head fitting part 1, the formation of a folding part 3 is first made on the connected portion to the inside part 1*a* of the head fitting part 1 by using a front knitting manner, where only the needles formed on the front needle bed of the knitting machine are used. Alternatively, by using a back knitting manner, where only the needles formed on the back needle bed of the knitting machine are used can form the folding part 3. The folding part 3 is a reference line in folding the head fitting part 1 in the process of sewing the piece of raw cloth for the cap as will be described below. That is, the folding part 3 is knitted between the inside part 1*a* and the outside part 1*b* of the head fitting part 1.

A crown 4 is then formed integrally in abutment with the root part of the brim 2 and the outside part 1*b* of the head fitting part 1, wherein the crown 4 is knitted in a Jacquard knitting manner where a predetermined image or logo may be formed.

In addition thereto, the crown 4 may form the whole pattern in any one of plain, link—link, cable, and Intarsia knitting manners.

The brim 2, the head fitting part 1, and the crown 4 are set knitted at one time by the knitting program on the computer connected to the knitting machine, and therefore, it is not necessary to sew the brim 2 and the crown 4 that are knitted separately in the conventional practices.

The crown 4 comes in direct contact with the head of the human body, and therefore, in order for it to have at a relatively high density in winter for giving a good heating efficiency and to have at a relatively low density in summer for giving a good ventilation efficiency, the knitting program is appropriately controlled.

In addition, upon knitting of the brim 2, the head fitting part 1, or the crown 4, a rubber yarn having flexibility is inserted such that the cap is applied in all kinds of sizes.

Consequently, the piece of raw cloth 10 for the cap is produced.

With the piece of raw cloth 10 for the cap, thereby, a series of sewing processes for making a brim-integrated type cap as shown in FIG. 2 are executed. First, the head fitting part 1 is folded relative to the folding part 3 and sewn. The brim 2 is sewn in the same manner as above. At this time, the brim 2 is sewn, but the insertion part of a brim pad 7 is not sewn. After the insertion of the brim pad 7, the brim 2 is completely sewn.

The piece of raw cloth 10 for the cap in the spreading form is rolled into the round form and the left and right edges thereof are sewn. In this case, the crown 4 of the round type of a piece of raw cloth 10 for the cap takes a generally cylindrical shape. At this time, in order for the crown 4 to take a similar shape to that of the head of the human being, the crown 4 is cut into predetermined parts on the upper portion thereof and sewn with each other to thereby form sewing lines 8.

The brim pad 7 is then inserted into the insertion part on the brim 2 and the insertion part is then sewn. After completing other finishing works, the manufacturing for the cap according to the first embodiment of the present invention is complete.

In this case, a poly yarn or a fixing yarn, such as vinyl chloride having a shape-maintaining characteristic, is inserted during knitting of the brim 2 and the crown 4. After the whole shape of the cap is once taken, the brim 2 and the crown 4 is placed into a mold for fixation thereof. As a result, the brim 2 can be freely bent without any insertion of the brim pad 7, and the crown 4 can be kept in the predetermined shape thereof. Therefore, this method may be applied in this embodiment of the present invention.

According to the method for manufacturing the brim-integrated type cap according to the first embodiment of the present invention, the brim 2 is formed in the plain and select knitting manners, the head fitting part 1 in an one-to-one knitting manner, the folding part 3 in the front or back knitting manner, and the crown 4 in any one of the Jacquard, plain, link—link, cable, and Intarsia knitting manners, whereby the piece of raw cloth 10 for the cap where the brim 2 and the crown 4 are formed integrally can be made. This enables the production cost thereof to be substantially reduced, and the insertion of the rubber yarn or the spandex yarn into the head fitting part 1 allows the head fitting part 1 to have an excellent flexibility, such that the cap can be applied in a variety of sizes.

Figure 3:
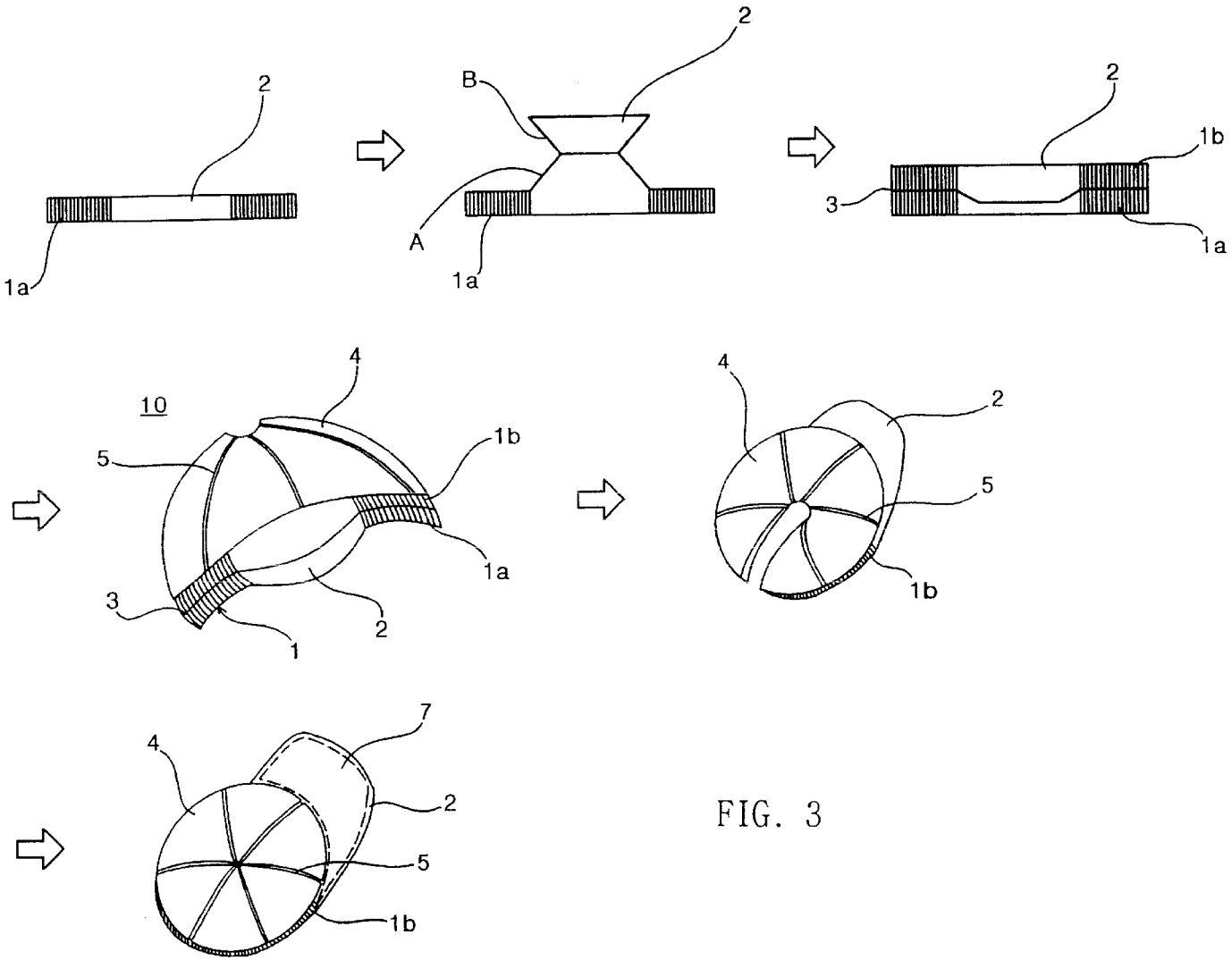
FIG. 3 is a flow diagram illustrating a method for manufacturing a brim-integrated type cap according to a second embodiment of the present invention.
Figure 4:
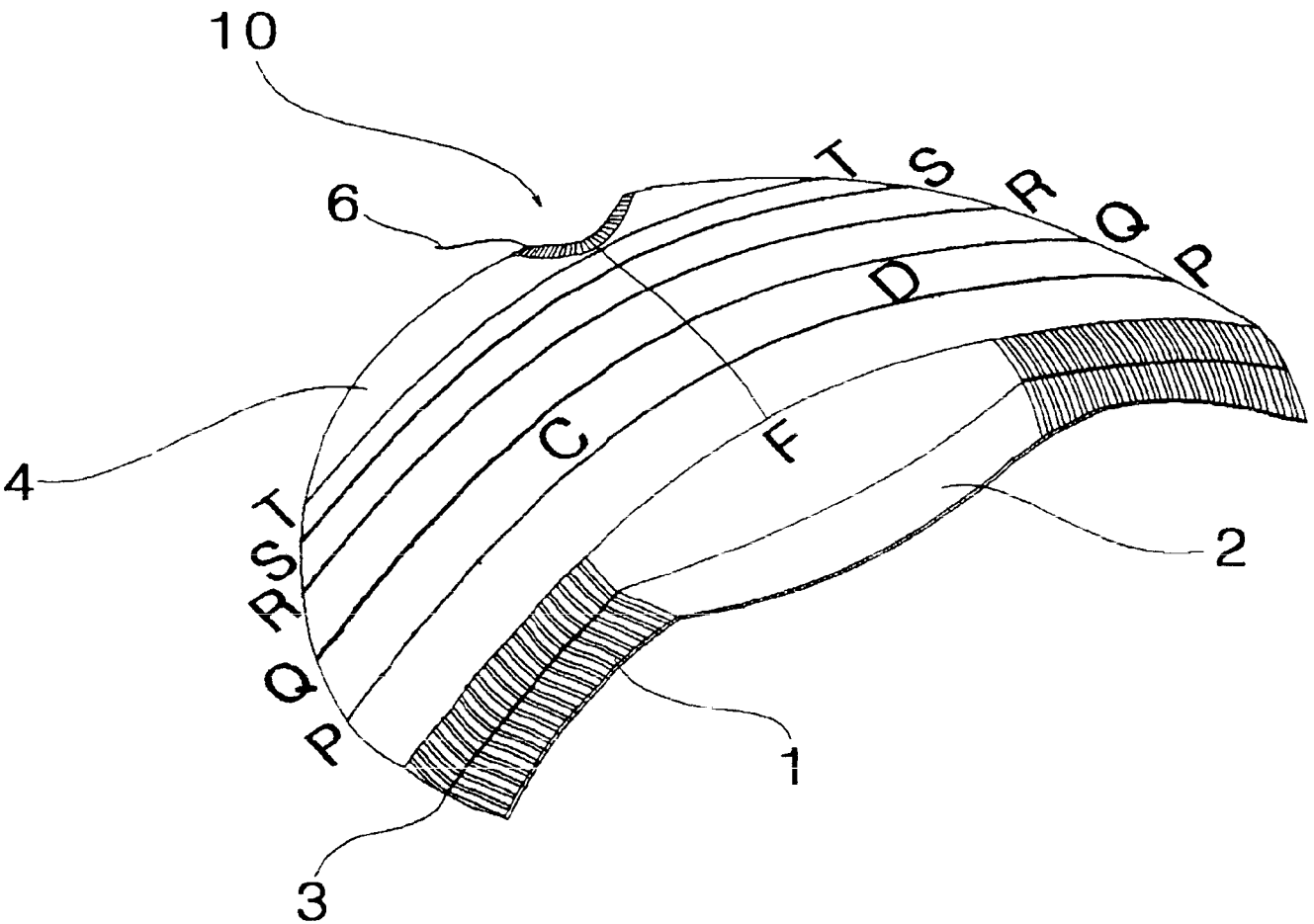
FIG. 4 is a perspective view illustrating a piece of raw cloth for the cap manufactured according to the second embodiment of the present invention.
Figure 5:
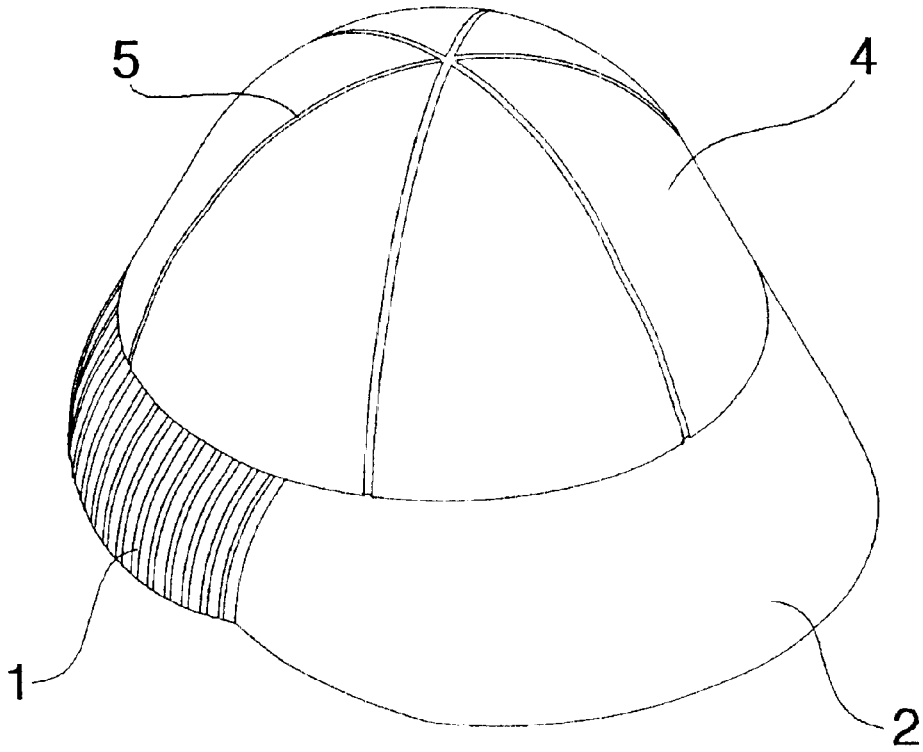
FIG. 5 is a perspective view illustrating the cap manufactured according to the principles of the second embodiment of the present invention.

FIG. 3 is a sequential diagram illustrating a method for manufacturing a brim-integrated type cap according to a second embodiment of the present invention. FIG. 4 is a perspective view illustrating the piece of raw cloth for the cap manufactured according to the second embodiment of the present invention. FIG. 5 is a perspective view illustrating the cap manufactured according to the second embodiment of the present invention.

In accordance with the second embodiment of the present invention, a piece of raw cloth 10 for the cap on which the sewing for the cut parts in the crown 4 has been completed is produced, whereby the manufacture of this cap can be finished without any additional process of sewing the cut parts in the crown 4.

According to the second embodiment of the present invention, the method for forming the head fitting part 1 and the brim 2 is the same as in the first embodiment of the present invention, and the crown 4 takes a generally semicircular shape.

Now, an explanation of the method for forming the crown 4 in the shape of a general semicircle will be given.

The crown 4 of the piece of raw cloth 10 for the cap is bent generally in the shape of a semicircle, not in the shape of a rectangle. The parts "P", "Q", "R", "S", and "T" as shown in FIG. 4 are formed in such a manner that the needles on the back needle bed move as the back needle bed moves as many as a predetermined needle number and thereby, the loops transfer inwards such that the knitting size is decreased. After the head fitting part 1 and the brim 2 are completed, the crown 4 starts to be knitted and stops knitting when it reaches the part "P". The loops transfer inward to thereby reduce the knitting size of the crown 4, and the crown 4 starts to be knitted again. If the crown 4 reaches the part "Q", it stops knitting, and the loops transfer inward to thereby reduce the knitting size of the crown 4. This is repeated when the crown 4 reaches the part "T".

An explanation of the method for reducing the knitting size of the crown 4 will now be given.

A letter "F" denotes a reference position indicating the center of the crown 4, and letters "C" and "D" denote the left and right areas relative to the reference position "F". The crown 4 is knitted and if it reaches the part "P", the positioning of the needles is reestablished such that the needles in the area "C" are positioned on the back needle bed and those in the area "D" are positioned on the front needle bed, wherein the front needle bed is in a fixed state and the back needle bed is movable left and right.

In order for the loops on the area "C" to transfer inwards, that is, in a direction of the reference position "F", the back needle bed moves by one needle number in the direction of the reference position "F". Thus, the needles on the back needle bed move to the front needle bed, such that the loops transfer inwards by the distance of the movement of the back needle bed. To fill the space caused by moving the loops by one needle number inwards, the back needle bed moves by two needle numbers and thus, the needles on the back needle bed move to the front needle bed, such that the loops transfer inwards. In the same manner as above, to fill the space caused by moving the loops by two needle numbers inward, the back needle bed moves by three, four, five, six or more needle numbers and thus, the loops transfer inwards.

As mentioned above, the back needle bed moves inward by the set needle number and thus, the needles on the back needle bed moves to the front needle bed such that the loops on the area "C" move inward and are knitted. Next, the area "D" is knitted in the same manner as the area "C", and in this case, the needles on the area "D" on the front needle bed are positioned again to the back needle bed. Then, while the back needle bed moves by one needle number in the direction of the reference position "F", the needles on the back needle bed move to the front needle bed such that the loops transfer inward by the distance of movement of the back needle bed. Thereby, the back needle bed moves by the set needle number such that the loops on the area "D" transfer inward.

When the loops transfer inward and are knitted, therefore, the knitting size corresponding to the loops transferred is reduced, and if knitting starts there, it is carried out in smaller size than before. If knitting reaches the area "Q", the above-described method for reducing the knitting size is carried out.

While knitting and the reduction of the knitting size are repeatedly carried out, the piece of raw cloth 10 for the cap is made, on which the crown 4 forms generally a semicircle and has the upper end greatly narrowed in width. With the piece of raw cloth 10 for the cap, the head fitting part 1 and the brim 2 are first sewn, and the left and right edges of the piece of raw cloth 10 for the cap are connected by sewing in the state where the piece of raw cloth 10 is rolled into a round shape. Finally the upper end of the crown 4 is sewn. The brim pad 7 is then inserted into the insertion part of the brim 2, and the insertion part is sewn, thereby completing the manufacturing procedure for the cap.

As shown in the embodiment of FIG. 4, the crown 4 is formed integrally with a plurality of cap shape maintaining parts 5 that are formed radially from the top end and to the bottom end thereof, such that the cap has the same shape as the conventional crown 4 having the process of sewing the cut parts thereon. Each of the plurality of cap shape maintaining parts 5 is grooved or protruded in accordance with the knitting program, and serves as the frame of the crown 4, with a result that the crown 4 can be kept in its original shape, without any squeezing. To maintain the shape of the cap in more effective way, the cap shape maintaining parts 5 are spaced equally.

In order for the crown 4 to be easily finished on the upper end thereof, a finishing yarn 6 is linked to the yarns knitted on the upper end of the crown 4. When the finishing yarn 6 pulls, the upper end of the crown 4 gathers with a result that the sewing process is completed with ease.

According to the above-mentioned procedure, the brim-integrated type cap according to the present invention is manufactured, and specifically, at the time of making the piece of raw cloth 10 for the cap the crown 4 is knitted with the inward movement of the loops carried out repeatedly at necessary positions, whereby the total number of processes for sewing the cut parts on the crown 4 can be reduced.

According to the knitting program, a pattern or a picture can be formed on the outside of the crown 4, such that the process of adding the pattern or logo on the surface of the crown 4 can be avoided.

As noted above, the method for manufacturing the brim-integrated type cap according to the second embodiment of the present invention can make the piece of raw cloth 10 for the cap on which the crown 4 is knitted with the inward movement of the loops carried out repeatedly at necessary positions, whereby the total number of processes for sewing the cut parts on the crown 4 can be reduced.

Figure 6:
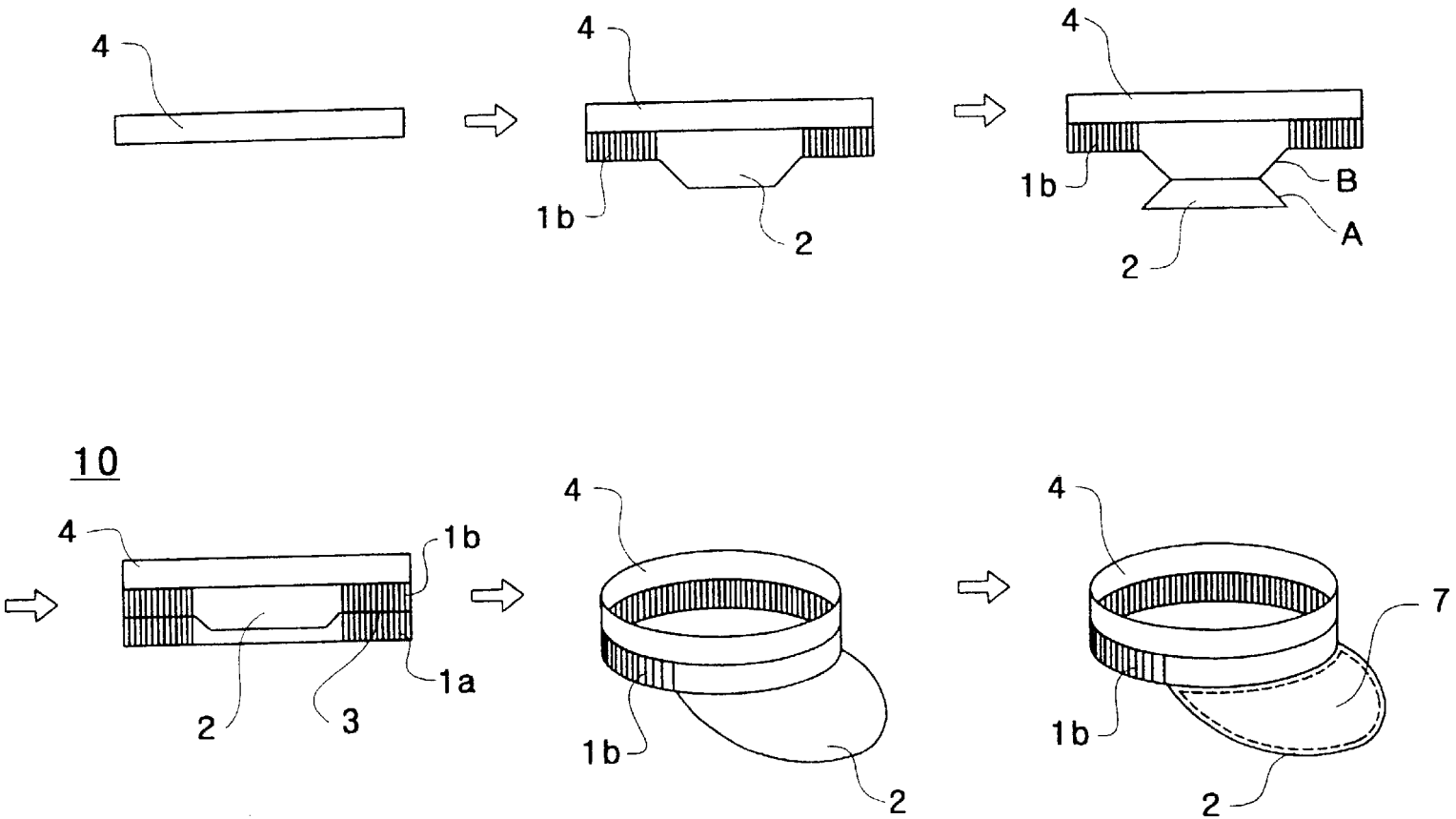
FIG. 6 is a flow diagram illustrating a method for manufacturing a brim-integrated type cap according to a third embodiment of the present invention.
Figure 7:
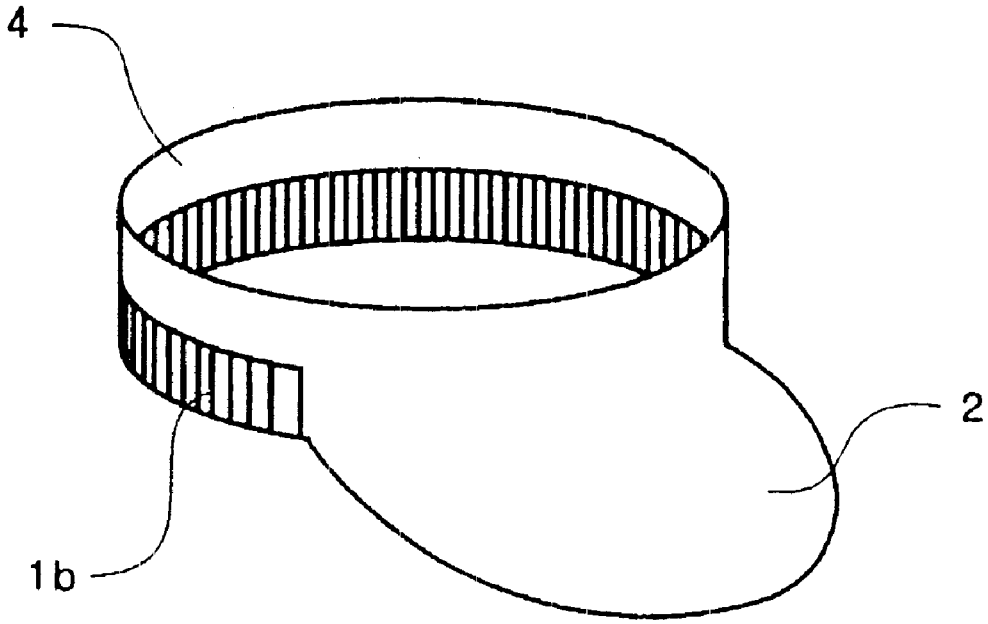
FIG. 7 is a perspective view illustrating the cap manufactured according to the third embodiment of the present invention.

FIG. 6 is a sequential diagram illustrating a method for manufacturing a brim-integrated type cap according to a third embodiment of the present invention. FIG. 7 is a perspective view illustrating the cap manufactured according to the third embodiment of the present invention.

The cap manufactured according to the third embodiment of the present invention has a crown 4 that is opened at the upper portion. The method for manufacturing the cap is carried out in the opposite order to that in the first embodiment of the present invention, but the basic manufacturing principles are same as in the first embodiment of the present invention.

The crown 4, which has a relatively long length when compared with its width, is first knitted.

Next, the outside part 1*b* of a head fitting part and the brim 2 are knitted integrally in abutment with the crown 4.

The outside part 1*b* of the head fitting part is formed in one to one knitting manner, and the brim 2 is formed in a plain knitting manner. While the brim 2 is knitted in the plain knitting manner, in this case, it is knitted in a select knitting manner where, first, it gradually decreases the knitting width and second, it gradually increases the knitting width when it reaches a predetermined knitting width.

In the processes of decreasing the knitting width and increasing the knitting width, the parts "A" and "B" are connected in such a manner as to be protruded upward, thereby forming the whole shape of the brim 2 like a pocket.

A folding part 3 is then formed in a front or back knitting manner such that the inside part 1*a* of the head fitting part to be formed in abutment with the outside part 1*b* of the head fitting part 1 can be easily folded.

While the inside part 1*a* of the head fitting part is being formed in an one-to-one knitting manner, the root part of the brim 2 is knitted.

Consequently, the piece of raw cloth 10 for the cap results.

The inside part 1*a* of the head fitting part is folded toward the inside of the crown 4 and sewn except for the insertion part of a brim pad 7.

Then, the left and right edges of the piece of raw cloth 10 for the cap are sewn to thereby form the body of the cap.

The brim pad 7 is inserted into the insertion part of the brim 2, and the insertion part is completely sewn.

The method for manufacturing the brim-integrated type cap according to the first embodiment of the present invention needs the finishing work for the upper portion thereof, whereas the method for manufacturing the brim-integrated type cap according to the third embodiment of the present invention achieves the finishing work for the lower portion by sewing the inside part 1*a* of the head fitting part, thereby rendering the production procedure considerably simplified.

Figure 8:
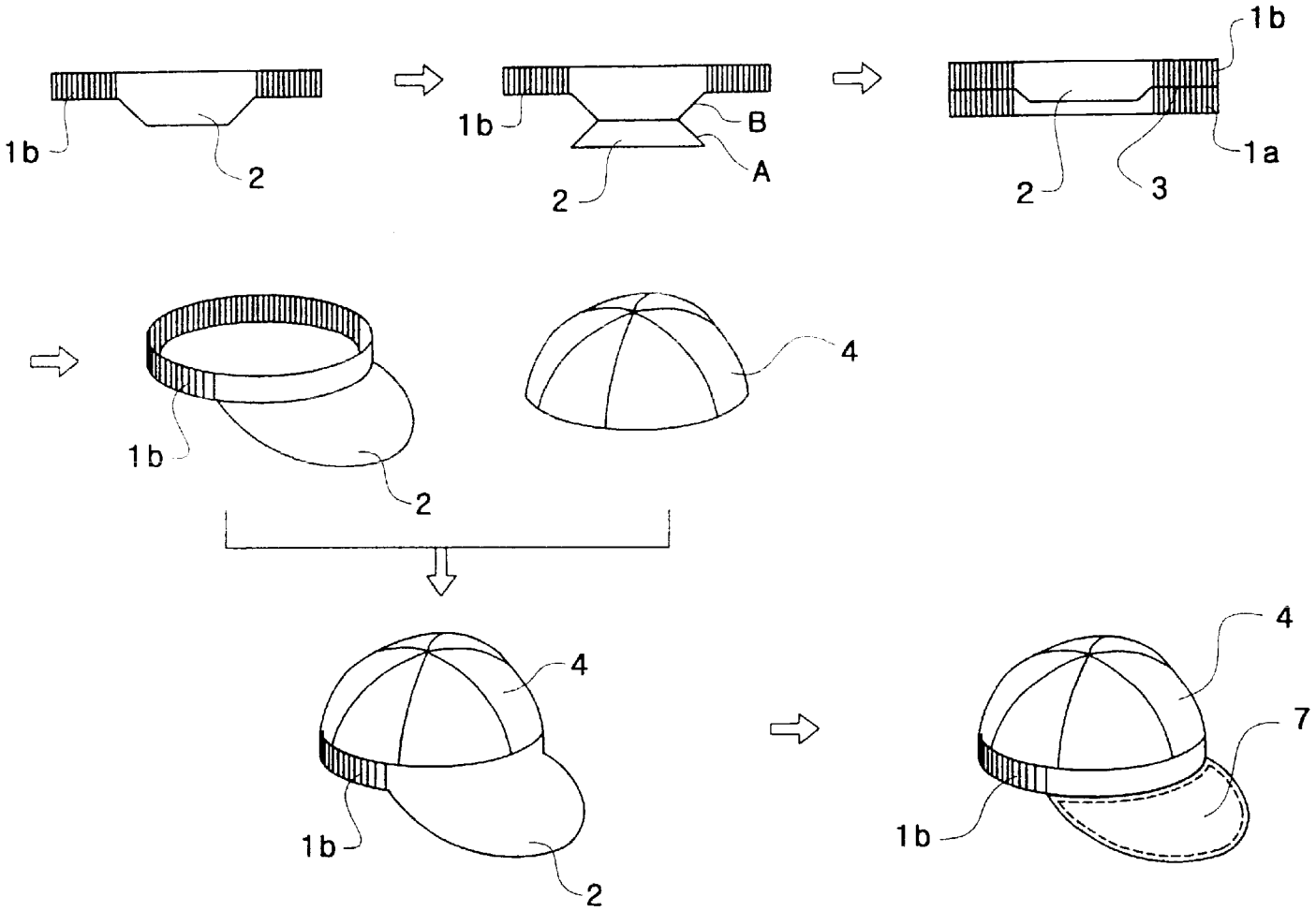
FIG. 8 is a flow diagram illustrating a method for manufacturing a brim-integrated type cap according to a fourth embodiment of the present invention.
Figure 9:
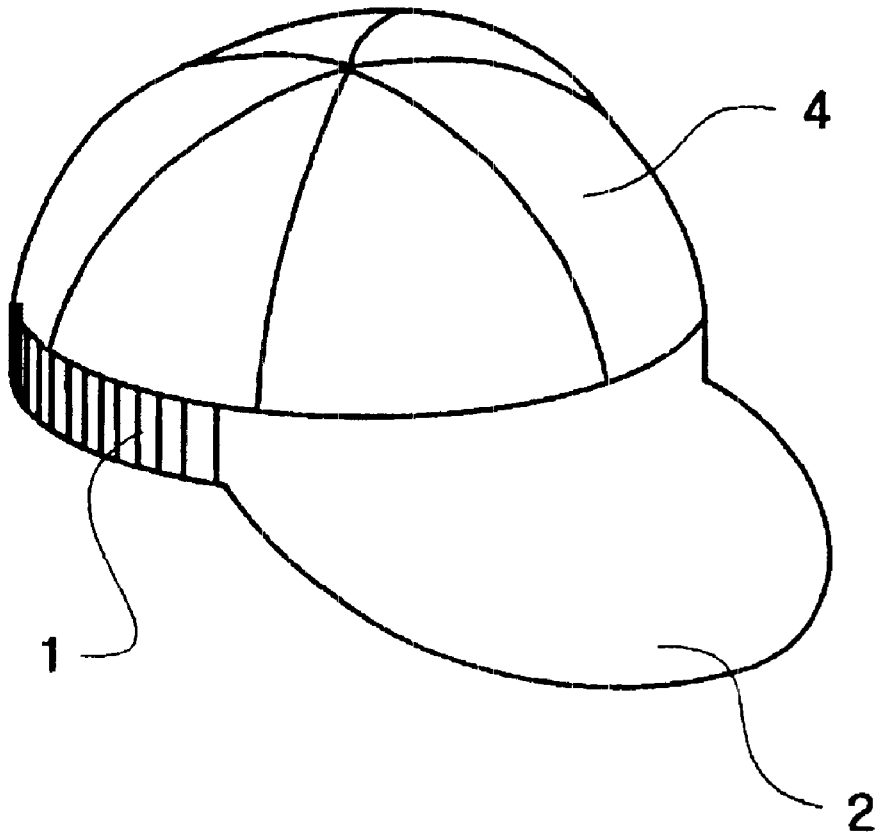
FIG. 9 is a perspective view illustrating the cap manufactured according to the fourth embodiment of the present invention.

FIG. 8 is a sequential diagram illustrating a method for manufacturing a brim-integrated type cap according to a fourth embodiment of the present invention. FIG. 9 is a perspective view illustrating the cap manufactured according to the third embodiment of the present invention.

The outside part 1*b* of a head fitting part and a brim 2 are first knitted.

The outside part 1*b* of the head fitting part is formed in one to one knitting manner, and the brim 2 is formed in a plain knitting manner. While the brim 2 is knitted in the plain knitting manner, in this case, the brim 2 is knitted in a select knitting manner where, first, it gradually decreases the knitting width and second, it gradually increases the knitting width when it reaches a predetermined knitting width.

During the processes of decreasing the knitting width, and increasing the knitting width the parts "A" and "B" are connected in such a manner as to be protruded upward, thereby forming the whole shape of the brim 2 like a pocket.

A folding part 3 is formed in a front or back knitting manner such that the inside part 1*a* of the head fitting part to be formed in abutment with the outside part 1*b* of the head fitting part 1 can be easily folded.

While the inside part 1*a* of the head fitting part is being formed in an one-to-one knitting manner, the root part of the brim 2 is knitted.

The inside part 1*a* of the head fitting part is folded inward and sewn except for the insertion part of a brim pad 7.

The crown 4 is then cut into four or six parts and the top ends of the four or six parts gather, such that the crown takes a generally round shape like a head, without any laying of the cut parts on another. Then, the respective cut parts are sewn with each other.

The left and right edges of the head fitting part are sewn together and the crown is sewn together with the head fitting part to thereby form the body of the cap.

The brim pad 7 is then inserted into the insertion part of the brim 2, and the insertion part is completely sewn.

As set forth in the foregoing, there is provided a method for manufacturing a brim-integrated type cap in which a cap is made of a piece of raw cloth for the cap in such a manner that a brim and a crown of the cap are formed integrally with each other, whereby the production cost of the cap can be considerably low.

What is claimed is:

1. A method for manufacturing a brim-integrated type cap, said method comprising the steps of:

forming one side of a head fitting part in a one-to-one knitting pattern, while forming a brim on the center thereof in a plain knitting pattern, the brim formed by using a select knitting manner where the knitting decreases in width to a predetermined width and then increases in width, and also knitted by connecting both peripheries thereof, such that the brim is generally in the shape of a pocket;

forming a folding part in at least one of a front and back knitting manner, such that a first side of the head fitting part knitted in abutment with a second side thereof is easily folded; and forming a root part of the brim, while the second side of the head fitting part is formed in a one-to-one knitting pattern.

2. The method according to claim 1, wherein said first side of said head fitting part is an inside part of said head fitting part, said second side of said head fitting part is an outside part of said head fitting part, and said method further comprising the steps of knitting a crown integrally in abutment with said outside part of said head fitting part to thereby make a piece of raw cloth for the cap, folding said inside part of said head fitting part into an inside of said crown and sewing said inside part of said head fitting part with the exception of an insertion part of a brim pad thereon, sewing left and right edges of said piece of raw cloth for the cap to thereby form a body of the cap, and inserting said brim pad into the insertion part of said brim and sewing said insertion part.

3. The method according to claim 2, wherein said crown of said piece of raw cloth for the cap is generally in the shape of a rectangle, and the step of forming said body of the cap is made by connecting the left and right edges of said piece of raw cloth for the cap, cutting the upper part of said crown into a plurality of parts spaced equally, and sewing the respective parts.

4. The method according to claim 2, wherein said crown of said piece of raw cloth for the cap is generally in the shape of a semicircle.

5. The method according to claim 4, wherein said crown comprises a plurality of cap shape maintaining parts that are formed radially from a top part to a bottom part thereof, each of said plurality of cap shape maintaining parts being at least one of grooved and protruded integrally on said crown.

6. The method according to claim 2, wherein said crown is knitted in a relatively low density such that said crown has a ventilation effect.

7. The method according to claim 2, wherein said crown forms a pattern in any one of Jacquard, plain, link—link, cable, and Intarsia knitting manners.

8. The method according to claim 2, wherein upon knitting of said crown, a rubber yarn having flexibility is inserted thereinto.

9. The method according to claim 1, wherein said brim is kept in an original shape thereof, without any insertion of a brim pad, by inserting a fixing yarn thereinto and placing the cap with said brim into a mold for fixing said brim.

10. The method according to claim 1, wherein upon knitting of said head fitting part, a rubber yarn having flexibility is inserted thereinto and at least one of a cotton yarn and a natural yarn having a sweat absorbing capability is contained therein.

11. The method according to claim 1, wherein said first side of said head fitting part is an outside part of said head fitting part, said second side of said head fitting part is an inside part of said head fitting part, and said method further comprising the steps of knitting a generally rectangular crown that has a relatively long length when compared with a width thereof to thereby make a piece of raw cloth for the cap, folding said inside part of said head fitting part into an inside of said crown and sewing said inside part of said head fitting part with the exception of an insertion part of a brim pad thereon, sewing left and right edges of said piece of raw cloth for the cap to thereby form a body of the cap, and inserting said brim pad into said insertion part and sewing said insertion part, wherein at said step of knitting said brim said outside part of said head fitting part and said brim are knitted integrally in abutment with said crown.

12. The method according to claim 1, wherein said first side of said head fitting part is an outside part of said head fitting part, said second side of said head fitting part is an inside part of said head fitting part, said method further comprising the steps of making a crown which has a generally round shape, folding said inside part of said head fitting part inward and sewing said inside part of said head fitting part with the exception of an insertion part of a brim pad thereon, sewing left and right edges of said head fitting part, sewing the crown and said head fitting part to thereby form a body of the cap, and inserting said brim pad into said insertion part and sewing said insertion part.

* * * * *

UNITED STATES PATENT AND TRADEMARK OFFICE

CERTIFICATE OF CORRECTION

PATENT NO. : 6,681,601 B2
DATED : January 27, 2004
INVENTOR(S) : Lee

It is certified that error appears in the above-identified patent and that said Letters Patent is hereby corrected as shown below:

Title page,
Item [76], Inventor, replace "Song-Taek Li" with -- Sung-Taek Lee --.

Signed and Sealed this

Twelfth Day of October, 2004

JON W. DUDAS
*Director of the United States Patent and Trademark Office*